US005090682A

United States Patent [19]

Takimoto

[11] Patent Number: 5,090,682

[45] Date of Patent: Feb. 25, 1992

[54] AUTOMATIC DOCUMENT FEEDER COMPRISING A GUIDE MEMBER

[75] Inventor: Kazushi Takimoto, Kodoma, Japan

[73] Assignee: Mita Industrial Co., Ltd., Osaka, Japan

[21] Appl. No.: 542,048

[22] Filed: Jun. 22, 1990

[30] Foreign Application Priority Data

Jun. 28, 1989 [JP] Japan ..... 1-167699
Jun. 30, 1989 [JP] Japan ..... 1-170976

[51] Int. Cl.[5] ..... B65H 5/00

[52] U.S. Cl. ..... 271/225; 271/3.1; 271/2.75

[58] Field of Search ..... 271/3, 3.1, 4, 7, 10, 271/184, 207-208, 225, 245-246, 902, 275

[56] References Cited

U.S. PATENT DOCUMENTS 4,291,974 9/1981 Silverberg ..... 271/245
4,465,272 8/1984 Kajita et al. ..... 271/245
4,565,462 1/1986 Yamamoto et al. ..... 400/625
4,629,173 12/1986 Hashimoto et al. ..... 271/291
4,761,001 8/1988 Hayakawa et al. ..... 271/3.1
4,781,371 11/1988 Stemmle ..... 271/212
4,866,485 9/1989 Simpson ..... 271/311
4,954,847 9/1990 Murata et al. ..... 271/3.1
4,975,749 12/1990 Tsunoda et al. ..... 271/902

FOREIGN PATENT DOCUMENTS 165539 10/1986 Japan .
1-236126 9/1989 Japan .

*Primary Examiner*—Robert P. Olszewski
*Assistant Examiner*—Boris Milef
*Attorney, Agent, or Firm*—Beveridge, DeGrandi & Weilacher

[57] ABSTRACT

An automatic document feeder includes a guide member which has a flexible thin piece. A plurality of recesses are formed in a free end of the guide member in spaced-apart relationship in a width direction to provide the plurality of recesses and a plurality of protrusions adjacent to the recesses. The recesses and protrusions are formed and disposed so that both side edges of original documents of various standard sizes may pass tip portions or outside edge portions of the protrusions. By this, both side edges of the original documents are without foil scooped by the protrusions. Accordingly, both edges of original documents do not enter the interior most portions of the recesses and thus a paper jam does not occur.

15 Claims, 11 Drawing Sheets

AUTOMATIC DOCUMENT FEEDER COMPRISING A GUIDE MEMBER

BACKGROUND OF THE INVENTION

1. Field of the Invention

The present invention relates to an automatic document feeder for an image forming apparatus such as an electrophotographic copying machine and a laser printer, and more particularly, to an automatic document feeder comprising a guide member for deflecting an orignal document being conveyed by conveying means.

2. Description of the Prior Art

In recent years, there have been many image forming apparatus, such as electrophotographic copying machines, each equipped with an automatic document feeder by which an original document is handled automatically.

The operation of said automatic document feeder is explained as follows, exemplifying the electrophotographic copying machine. The automatic document feeder comprises conveying means such as a conveying belt and a feed roller. The conveying means automatically feeds the original document to a transparent plate disposed at an upper part of the body of the copying machine. The original document placed on the transparent plate is exposed to light. After the exposure, the original document is automatically conveyed out of and discharged from the transparent plate by the conveying means. At this time, the original document conveyed by the conveying means is deflected by a guide member in the discharging direction.

Conventionally, the guide member is formed of a flexible thin piece such as a synthetic resin film, and normally, formed of a rectangular film of a predetermined size cut out in a rolled synthetic resin film. When the guide member formed of this rectangular film is used, one end of the guide member is fixed to a support member such as an iron plate and the other free end is elastically in contact with a predetermined portion. It is noted that the predetermined portion is a concave portion formed on the transparent plate, an upper surface of a receiving member disposed on a downstream side of the transparent plate in the conveying direction, or so like.

However, if the free end of the guide member is formed straight, the free end waves in a width direction and is sectionally detached from said predetermined portion. Accordingly, a space occurs between the free end of the guide member and said predetermined portion and consequently, sometimes a front edge of the original document passing in the discharging direction is caught in said space which causes a paper jam. This problem occurs similarly even if the free end of the guide member is forcibly in contact with said predetermined portion.

SUMMARY OF THE INVENTION

The principal object of the present invention is to provide an automatic document feeder capable of deflecting without fail an original document being conveyed by conveying means without occurrence of a paper jam.

In order to attain the object, an automatic document feeder of the present invention comprises a guide member comprised of a flexible thin piece, and a plurality of recesses are formed in a free end of a guide member in spaced-apart relationship in a width direction to constitute the plurality of recesses and a plurality of protrusions adjacent to the recesses. The recesses and protrusions are formed and disposed so that both side edges of original documents of various standard sizes may pass tip portions or outside edge portions of the protrusions. As such constructed, both edges of each of the original documents are scooped up by the protrusions without fail. Accordingly, both edges of the original documents do not go into most interior portions of the recesses and thus paper jam is prevented.

BRIEF DESCRIPTION OF THE DRAWINGS

FIG. 8A is a sectional view taken on line VIIIA—VIIIA in FIG. 7 and FIG. 8B is a sectional view taken on line VIIIB—VIIIB in FIG. 7;

DETAILED DESCRIPTION OF THE PREFERRED EMBODIMENT

Next, preferred embodiments of the present invention are described in conjunction with the drawings.

Figure 1:
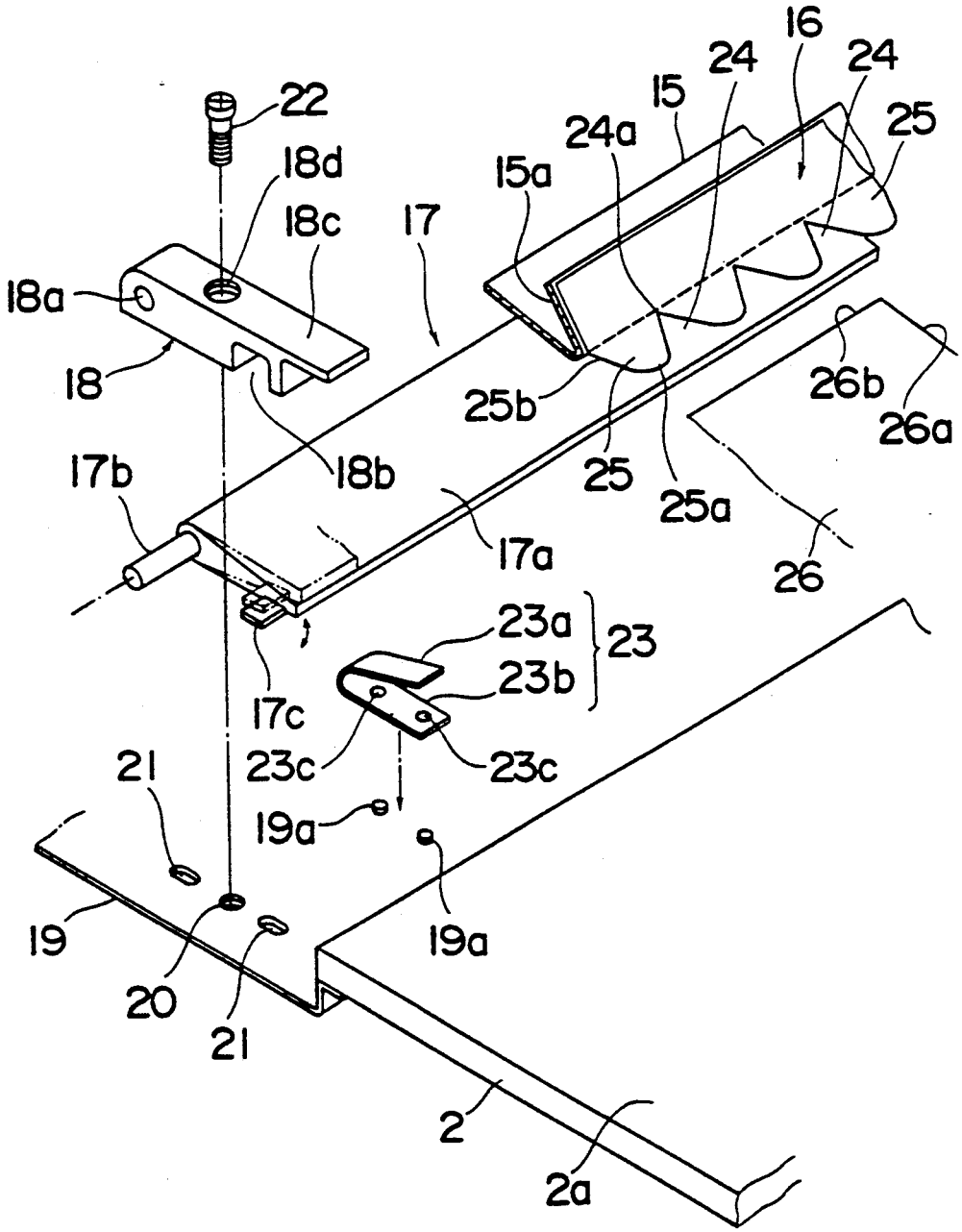
FIG. 1 is an exploded perspective view showing a principal portion of an automatic document feeder of the present invention.
Figure 2:
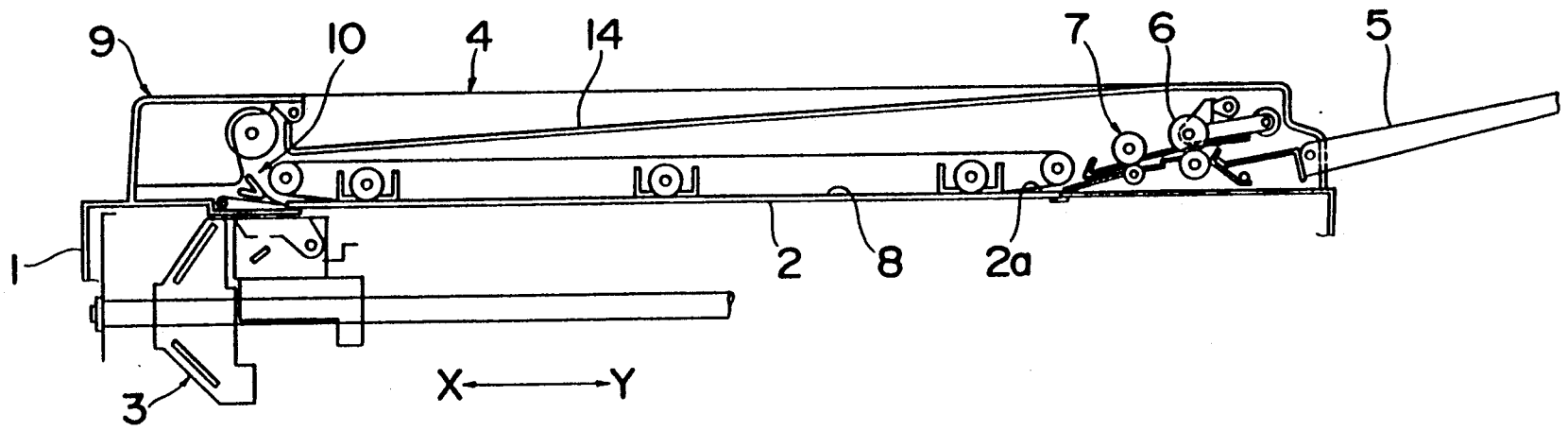
FIG. 2 is a schematic view showing the whole automatic document feeder of FIG. 1.
Figure 3:
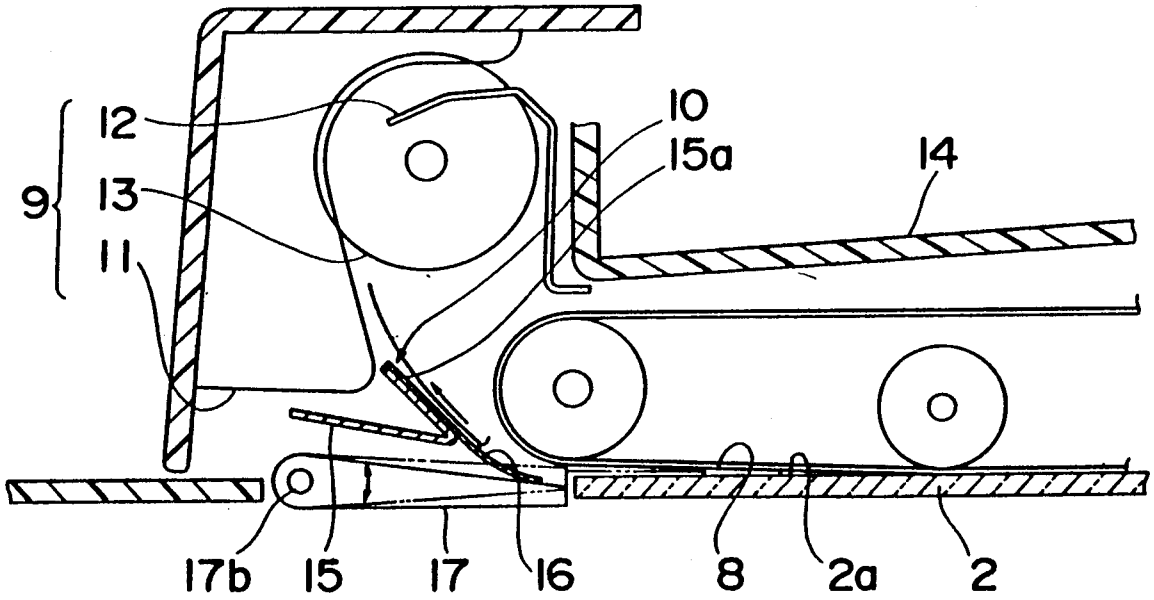
FIG. 3 is a sectional view of an enlarged principal portion of the automatic document feeder of FIG. 2.

FIGS. 1 through 6 show an embodiment of the present invention. FIG. 2 is a schematic view showing an example of an automatic document feeder. FIG. 3 is a sectional view of an enlarged principal portion of the automatic document feeder of FIG. 2.

In FIG. 2, a numeral 1 designates an electro-photographic copying machine as an example of an image forming apparatus and a transparent plate 2 is disposed on the upper side of said body 1. An exposure device disposed below the transparent plate 2 reciprocates in a direction of X-Y by a driving means (not shown). An automatic document feeder 4 is disposed on the copying machine body 1. A principal portion of the automatic document feeder 4 is rotatably attached to the copying machine body 1. The axis of the rotation is a line extending along an edge of the transparent plate 2 and the rotation is between a close state with the transparent plate 2 covered and an open state with the transparent plate 2 exposed. In FIG. 2, the principal of the automatic document feeder 4 is in the close state.

The automatic document feeder 4 comprises a document tray 5 disposed on a right hand side in FIG. 2. Further, the feeder 4 comprises means for conveying an original document and as said conveying means, a paper feed roller 6, a pair of resist rollers 7, a conveying belt 8, and a document discharging mechanism 9 are disposed in this order along a conveying direction. The conveying belt 8 is disposed so as to be generally in touch with the upper surface 2*a* of the transparent plate 2 in said close state. As shown in FIG. 3, the document discharging mechanism 9 comprises a guide rib 11, a guide member 12, and a discharge roller 13. A document receiving portion 14 is disposed on an upper side of the automatic document feeder 4 and on the downstream side of the document discharging mechanism 9 in the conveying direction.

A document guide means 10 is disposed between the conveying belt 8 and the document discharging mechanism 9 in the conveying direction. The structure of the document guide means 10 is explained referring to FIGS. 1 and 3 as follows.

The document guide means 10 comprises a support member 15 and a guide member 16. The support member 15 is made of a rigid body and is bent so as to form an appropriate angle. One end of the guide member 16 formed of a flexible thin piece is fixed on an upper portion 15*a* of the bent support member 15. A free end of the guide member 16 projects inclinedly so as to be directed to the transparent plate 2 and the conveying belt 8. The free end of the guide member 16 is elastically in contact with the upper surface 17*a* of a receiving member 17 disposed on downstream side of the transparent plate 2. As the free end of the guide member 16 is in contact with the receiving member 17, the distance of a path between the transparent plate 2 and the document receiving portion 14 can be short. Accordingly, a previous document can be discharged at the same time a subsequent document is fed to the transparent plate 2. Further, a downstream side roller of the conveying belt 8 can be coupled with the discharge roller 13 by a driving belt, thus the driving mechanism can be simplified. Still further, the whole apparatus can be compact. The guide member 16 will be described in detail later.

The receiving member 17 is rotatable between a first position above the transparent plate 2 (shown by the alternate long and two short dashes line in FIG. 3) and a second position below upper surface 2*a* of the transparent plate 2 (shown by the continuous line in FIG. 3) around a rotation shaft 17*b*. The width of the receiving member 17 is generally the same as that of the transparent plate 2. The rotation axes 17*b* and rotation regulate pieces 17*c* are protrudingly disposed at both sides of the receiving member 17. In FIG. 1, only one of the two rotation axes 17*b* and only one of the two rotation regulate pieces 17*c* are shown.

The receiving member 17 is attached to the upper side of the copying machine body 1 by attachment members 18 (in FIG. 1, only one of the two is shown). The attachment members 18 are disposed at both sides of the receiving member 17 in the width direction. Each of the attachment members 18 comprises a hole 18*a* for rotatably supporting the rotation shaft 17*b*, a rotation regulate channel 18*b*, engaged with said rotation regulate piece 17*c* for regulating a rotation range of the receiving member 17, a piece 18*c* for pressing the transparent plate 2 downward, a vertical through hole 18*d*, and two locating lugs (not shown) disposed at the lower side of the attachment member 18. On the other hand, a tapped hole 20 corresponding to the hole 18*d* of the attachment member 18 and two locating slots 21 corresponding to the locating lugs of the attachment member 18 are formed at an upper side member 19 of the copying machine body 1.

Each of the rotation shafts 17*b* of the receiving member 17 is inserted in each of the holes 18*a* of the attachment member 18. Each of the rotation regulate pieces 17*c* of the receiving member 17 is engaged with one rotation regulate channel 18*b* of the attachment member 18. Then, the locating lugs of the attachment member 18 are inserted in the slots 21 and a screw 22 is inserted downward in the hole 18*d* and the tapped hole 20 for fixing. By this, the attachment member 18 is fixed at a predetermined portion of the upper side of the copying machine body 1 and the receiving member 17 is rotatably supported by the attachment member 18 and is rotated around the rotation shaft 17*b*. The receiving member 17 is rotated within the range between the first position where the upper surface of the rotation regulate piece 17*c* is in contact with the inside upper side of the rotation regulate channel 18*b* and the second position where the lower side of the receiving member 17 is in contact with the upper side member 19 of the copying machine body 1. As above-mentioned, when the receiving member 17 is located at the first position, the edge of the receiving member 17 is above the upper surface 2*a* of the transparent plate 2 and when the receiving member 17 is located at the second position, said edge is below said upper surface 2*a*. When the original document is located by hand on the transparent plate 2 with the automatic document feeder 4 being in the open state, the receiving member 17 is located at the first position and it makes easy to position the document on the transparent plate 2. On the other hand, when the automatic document feeder 4 is in the close state, the receiving member 17 is located at the second position so as not to prevent the original document from being discharged from the transparent plate 2 by using the automatic document feeder 4. The piece 18*c* of the attachment member 18 supports the transparent plate 2 together with the edge of the upper side member 19 by the contact of a lower surface of the piece 18*c* with the upper surface 2*a* of the transparent plate 2.

Further, leaf springs 23 (in FIG. 1, only one of the two is shown) are disposed between the receiving member 17 and the upper side member 19 of the copying machine body 1. The leaf spring 23 comprises the upper portion 23*a* in contact with the lower side of the receiving member 17 and the lower portion 23*b* in contact with the upper side member 19. At the lower portion 23*b*, two through holes 23*c* are disposed which are engaged with locating lugs 19*a* disposed at the upper side member 19. The receiving member 17 is biased upward (in the direction of the first position) by the elastic power by the deformation of the leaf spring 23. When the automatic document feeder 4 is in the close state, the receiving member 17 is located downward (in the direction of the second position) against the elastic power of the leaf spring 23 by a positioning means such as a projection provided at the automatic document feeder 4. Thus, when the original document is fed by the automatic document feeder 4, the document passing the upper surface of the receiving member 17 located at the second position is deflected upward by the guide member 16.

Figure 4:
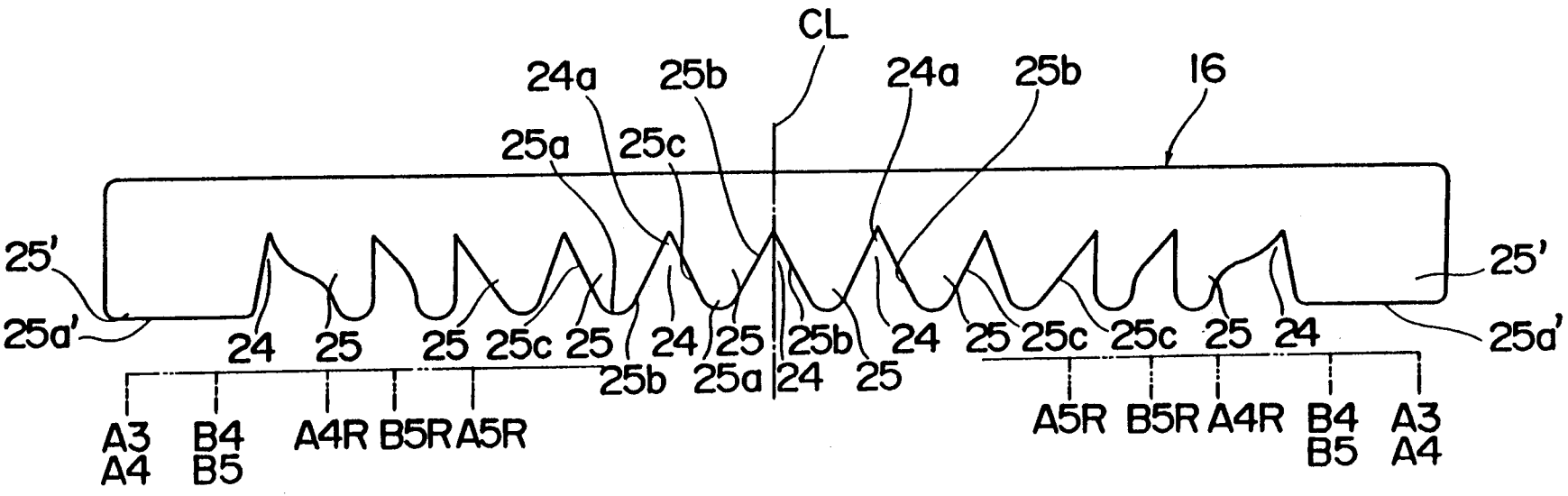
FIG. 4 is a plan view showing a first embodiment of a guide member of the present invention.

Next, the guide member 16 is described in detail as follows. As the guide member 16, a relatively thin and flexible member, for example, a synthetic resin film such as a polyethylene terephthalate of less than 0.1 mm in thickness and an electrically conductive metal foil is used. Referring to FIG. 4, the width of the guide member 16 is generally the same as that of the support member 15 and a plurality of recesses 24 are formed in the free end of the guide member 16 in spaced-apart relationship in the width direction. Each of protrusions 25 are formed between one recess 24 and another recess 24 adjacent to it. The guide member 16 thus comprises a plurality of recesses 24 and a plurality of protrusions 25 adjacent to the recesses 24, and only the protrusions 25 are in contact with the upper surface of the receiving member 17. The reason for this is to prevent the free end of the guide member 16 from waving in the width direction. If, as in a prior art guide member, the free end of the guide member is formed straight, it is difficult to make the whole of the free end completely in contact with the receiving member 17. Consequently, the free end of the guide member is sectionally detached from the receiving member 17 and the front edge of the document is caught in the detached portion, which causes a paper jam. On the other hand, as the guide member 16 of the present invention comprises a plurality of recesses 24 in its free end, the protrusions 25 can be made completely in contact with the receiving member 17. Accordingly, the original document can be scooped up without fail by the protrusions 25 completely in contact with the receiving member 17.

Figure 16:
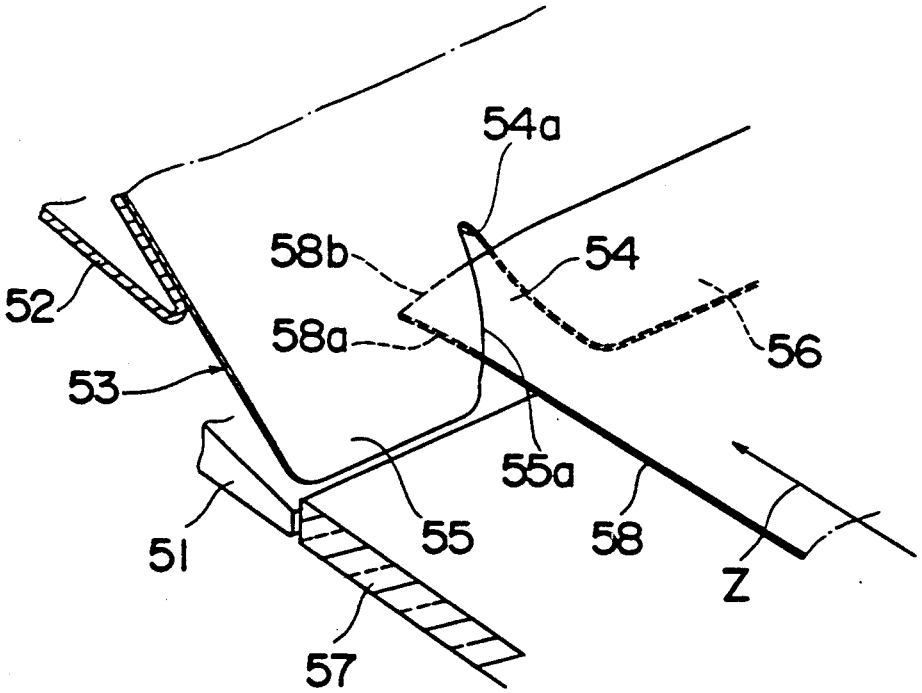
FIG. 16 is a perspective view explaining a state of a front edge of the original document caught in an interior most portion of a recess.

However, if the plurality of recesses are disposed in the guide member 16 without considering the locations of the side edges of original documents of various standard sizes, the following problem is caused. FIG. 16 is a figure explaining a state where the problem is caused. In FIG. 16, one end of a guide member 53 is supported by a support member 52 and the free end of the guide member 53 is in contact with a receiving member 51. A plurality of recesses 54 are formed in the free end of the guide member 53 in spaced-apart relationship in the width direction. In FIG. 16, only one recess 54 is shown. Protrusions 55 and 56 are adjacent to the recess 54. An original document 58 passes the upper surface of a transparent plate 57 in the direction of an arrow Z. When the original document 58 is deflected upward by the guide member 53, sometimes a front part of a side edge 58*a* of the original document 58 does not get onto the protrusion 55 but goes into the recess 54 and the original document 58 goes with the front part of the side edge 58*a* crossing an inside edge portion 55*a* of the protrusion 55. If the original document 58 goes farther, the front edge 58*b* of the original 58 is engaged with the interior most portion 54*a* of the recess 54. Consequently, the guide member 53 cannot scoop up the original document smoothly, and a paper jam is caused.

Figure 6:
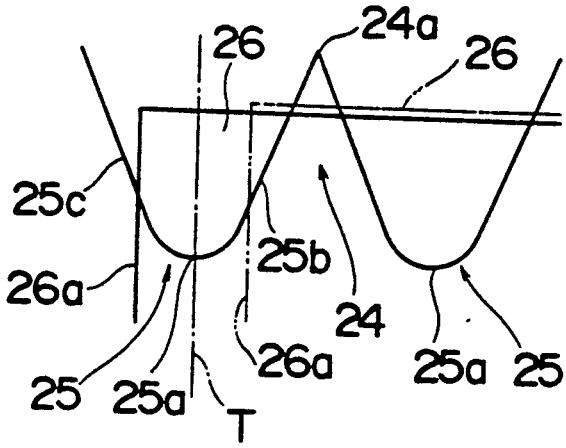
FIG. 6 is a conceptual view explaining how the original document passes the guide member of FIG. 4.

Further, description of this problem with more detailed analysis is as follows. Referring back to FIG. 4, each of the interior most portions 24*a* of the recesses 24 is disposed between the tip portion 25*a* of one protrusion 25 adjacent to the recess 24 and the tip portion 25*a* of another protrusion 25 adjacent to the recess 24. Consequently, if a plurality of recesses 24 and a plurality of protrusions 25 are formed without considering their relationship with both side edges of original documents of various standard sizes, as shown in FIG. 6, for example, the left side edge 26*a* of the original document can pass the outside edge portion 25*c* of the protrusion 25 as shown by the continuous line, or, can pass the inside edge portion 25*b* of the protrusion 25 as shown by the alternating long and two short dashes line. The following is a more detailed description. The protrusion 25 can be divided into two parts: an outside part including the outside edge portion 25*c* located outside (in FIG. 6, on the left of) a line T which goes across the tip portion 25*a* of the protrusion 25 in the conveying direction; and an inside part including the inside edge portion 25*b* located inside (in FIG. 6, on the right of) the line T. As shown in FIG. 3, the guide member 16 inclinedly projects with its free end in contact with the upper surface 17*a* of the receiving member 17. Only the tip portion 25*a* is in contact with the upper surface 17*a* and the rest of the protrusion is detached from the upper surface 17*a*. Accordingly, when the left edge 26*a* of the original document 26 passes the inside edge portion 25*b* as shown by the alternating long and two short dashes line, as a portion around the left front corner of the original document 26 does not pass the tip portion 25*a*, the left front corner portion of the original document 26 is not scooped up by the guide member 16. And the left front corner portion goes behind the guide member 16 through the recess 24 and crosses the inside edge portion 25*b*. Consequently, if the original document 26 goes farther, as shown in FIG. 17, the front edge 26*b* of the original document 26 engages with the interior most portion 24*a* of the recess 24 and a paper jam is caused.

Figure 5:
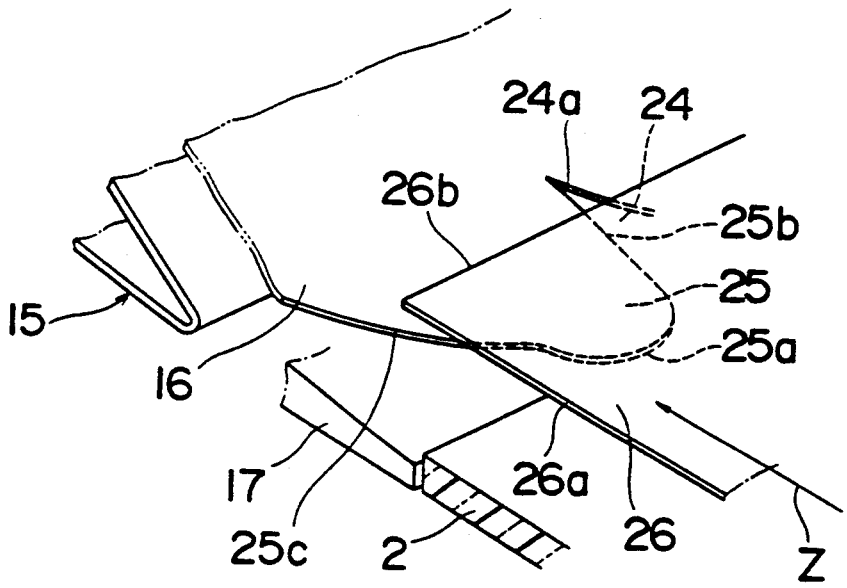
FIG. 5 is a perspective view explaining how an original document passes the guide member of FIG. 4.

On the other hand, when the left edge 26*a* of the document 26 passes the tip portion 25*a* or the outside edge portion 25*c* of the protrusion 25 as shown in the continuous line, the portion around the left front corner of the original document 26 passes the tip portion 25*a* of the protrusion 25. Accordingly, as shown in FIG. 5, the corner portion of the original document 26 is scooped up by the tip portion 25*a* without fail. So if the recesses 24 and the protrusions 25 are formed and disposed so that both side edges of original documents of various standard sizes may pass only the tip portions 25*a* or the outside edge portions 25*c* and may not pass the inside edge portions 25*b*, any original documents 26 are guided by the guide member 16 without fail and without a paper jam.

Accordingly, in FIG. 4, the relationship between the guide member 16 and both side edges of original documents of various standard sizes is as follows. The sizes of documents specified by JIS, that is, A3 through A5R are shown in alternating long and two short dashes lines at the bottom of FIG. 4. As is clear from FIG. 4, the recesses 24 and the protrusions 25 are formed and disposed so that both side edges of original documents of various standard sizes may pass only the tip portion 25*a* or the outside edge portion 25*c* of the protrusions 25 and may not pass the inside edge portions 25*b*.

FIG. 5 is a view showing how the left side edge 26*a* of the original document 26 passes. As for the right side edge of the original document 26, different from FIG. 6, the outside in FIG. 6 is the inside and the inside in FIG. 6 is outside. In the embodiment shown in FIG. 4, as the center of original documents passes the center line CL, the form and location of the recesses 24 and the protrusions 25 are symmetrical with respect to the center line CL. Also, the outside edge portions 25c and the inside edge portions 25b of the protrusions 25 are symmetrical with respect to the center line CL.

Further, in the embodiment shown in FIG. 4, the form of each protrusion of a first set of the protrusions 25 around the center line CL is symmetrical, but on the other hand, where both side edges of various standard sizes mainly pass and far from the center line CL, the recesses 24 extend outside and the form of each protrusion of a second set of the protrusions 25 is not symmetrical. This is a result of making both side edges of various standard sizes pass only the tip portions 25a or the outside edge portions 25c of the protrusions 25 and not pass the inside edge portions 25b.

Figure 7:
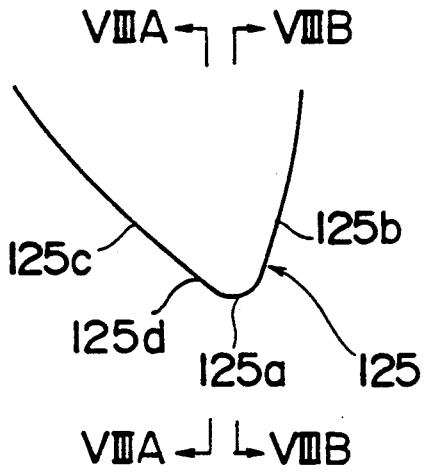
FIG. 7 is a plan view of a protrusion which is formed asymmetrically.
Figure 8A:
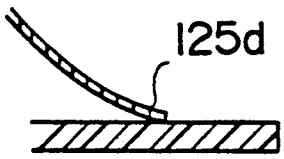
FIG. 8A and FIG. 8B are sectional views explaining a state of elastic contact of a guide member having the protrusion of FIG. 7 with a receiving member.
Figure 8B:
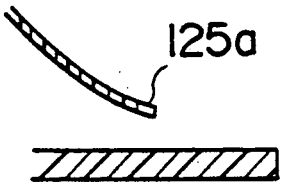

If each of the protrusions is the protrusion 125 shown in FIG. 7, which is completely asymmetrical, when the protrusion 125 is elastically in contact with the receiving member 17, the protrusion 125 is not in contact with the receiving member 17 at the tip portion 125a, but at a point 125d in the outside edge portion 125c. The directions of the pressing and the extending direction of the protrusion are different and thus, as shown in FIG. 8A, said point 125d is in contact with the receiving member 17, but as shown in FIG. 8B, there is a possibility that the tip portion 125a is detached a little from the receiving member 17. Consequently, there is a possibility that the front edge 26b of the original document 26 is caught in the interior most portion 24a of the recess 24 after the document 26 passes the tip portion 125a, which causes a paper jam.

Figure 9:
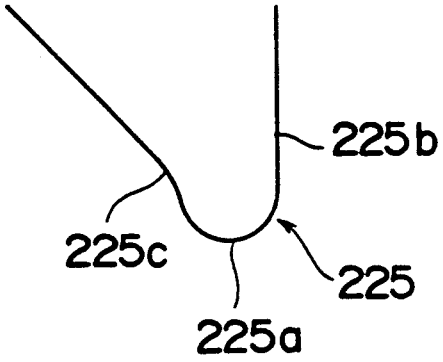
FIG. 9 is a plan view of an improvement of the protrusion of FIG. 7.

From this viewpoint, it is preferable that each of the protrusions are formed symmetrically. Even if each of the protrusions are not formed symmetrically, it is preferable that at least a portion around the tip portion 225a of the protrusion 225 is formed symmetrically, as in the protrusion 225 shown in FIG. 9. Accordingly, in FIG. 4, where both side edges of various standard sizes mainly pass and far from the center line CL, the protrusions 25 are formed as shown in FIG. 9.

Figure 10:
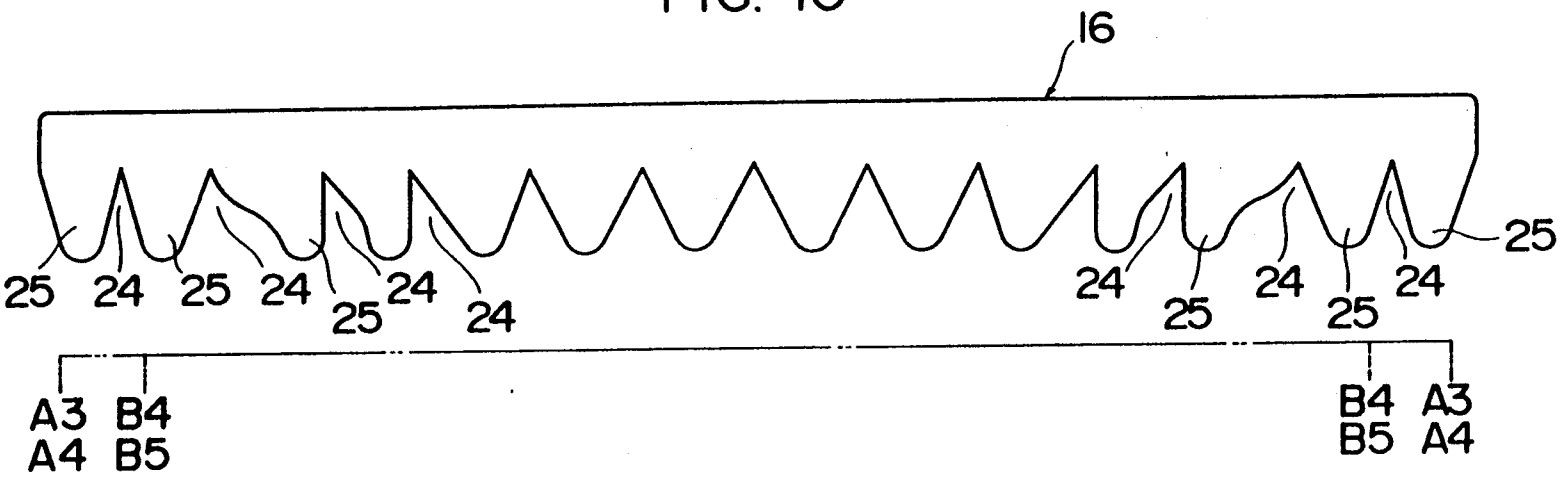
FIG. 10 is a plan view showing a second embodiment of a guide member of the present invention.

Further, in the guide member 16 shown in FIG. 4, the tip portions 25a' of the two protrusions 25 where both side edges of B4(B5) and A3(A4) documents which are relatively large sizes pass, is formed flatly. Instead of this, as shown in FIG. 10, the recesses 24 and protrusions 25 may be formed and disposed so that both side edges of B4(B5) and A3(A4) documents may pass only the tip portions or the outside portions of the protrusions 25. Further, as shown in FIG. 11, protrusions 25' having tip portions 25a' of flat forms may be formed not only at the ends of the guide member 16 in the width direction but all over the guide member 16 in the width direction and the same outside edge portion of a protrusion may be commonly used for original documents of a plurality of (for example, two kinds of) sizes.

Figure 11:
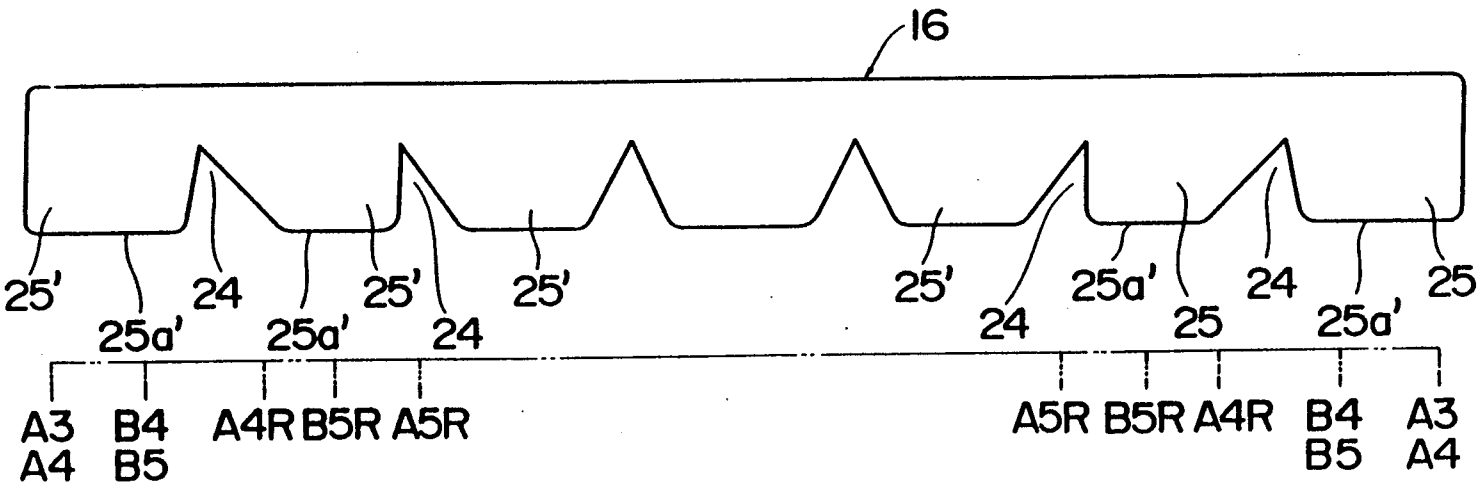
FIG. 11 is a plan view showing a third embodiment of a guide member of the present invention.
Figure 12:
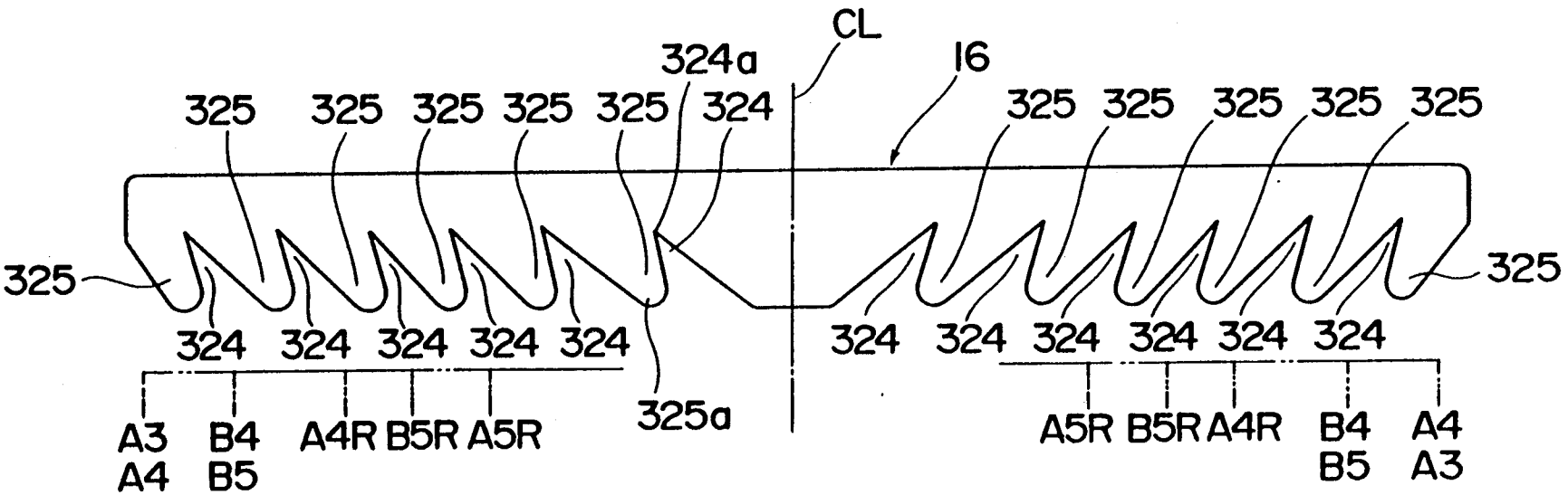
FIG. 12 is a plan view showing a fourth embodiment of a guide member of the present invention.
Figure 13:
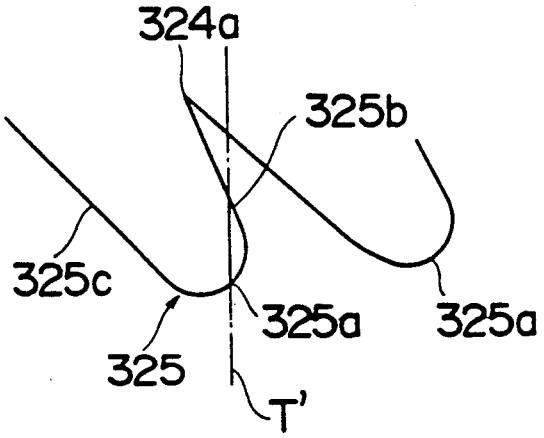
FIG. 13 is a plan view showing an enlarged principal portion of the guide member of FIG. 12.
Figure 14:
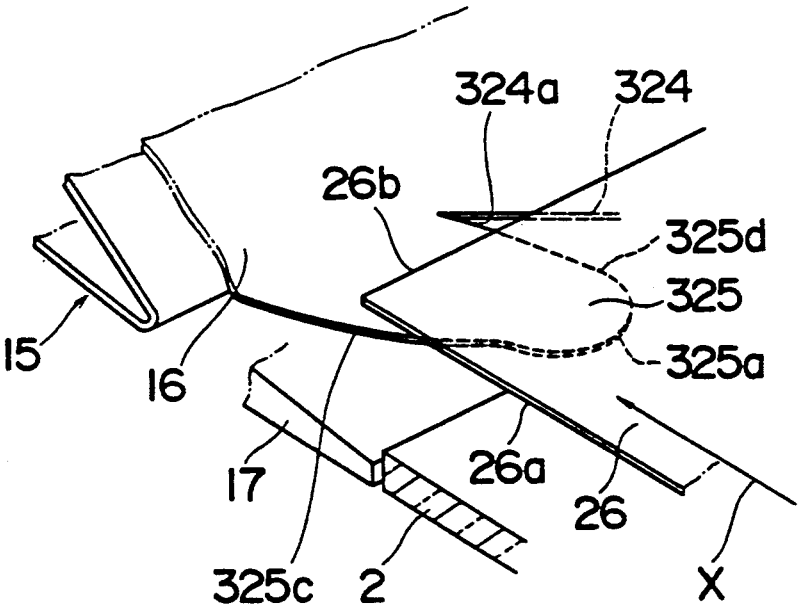
FIG. 14 is a perspective view explaining how the original document passes the guide member of FIG. 12.

FIG. 12 is a view showing another embodiment of a guide member of the present invention. In this embodiment, recesses 324 extend outward and the interior most portion 324a of each of the recesses 324 is disposed to be located outside tip portions 325a of the two protrusions adjacent to the recess 324 in the width direction. A more detailed description referring to FIG. 13 is as follows. The most interior portion 324a of the recess 324 is located outside a line T' extending in the conveying direction which passes the tip portion 325a of the protrusion 325 which is outside (the left hand side in FIG. 13) the recess 324 and which is adjacent to the recess 324. Accordingly, as shown in FIGS. 13 and 14, the left side edge 26a of the original document 26 always passes the tip portion 325a or an outside edge portion 325c of the protrusion 325. Accordingly, different from in the above-mentioned embodiments of FIGS. 4 through 11, it is not necessary to prevent both side edges of an original document from passing the inside edge portions. Thus, as the left side edge 26a of the original document 26 always passes the outside edge portion 325c of the protrusion 325, the portion around the left front corner of the original document 26 always passes the tip portion 325a of the protrusion 325. Accordingly, as is shown in FIG. 14, the left front corner of the original document 26 is scooped up by the tip portion 325a without fail, and thus the original 26 can be guided upward without fail. The forms and locations of the recesses 324 and the protrusions 325 of the guide member 16 in FIG. 12 are, as well as those in FIGS. 4, etc., symmetrical with respect to a center line CL. By this, both side edges of original documents of various standard sizes can be guided without fail.

Further, as is shown especially clearly in FIG. 14, only the tip portion 325a of the protrusion 325 may be formed symmetrically. If the tip portion 325a is formed like this, as was explained according to FIG. 9, the tip portion 325a of the protrusion 325 is not detached from the receiving member 17 and thus the front edge 26b of the original document 26 is not caught. However, if the tip portion 325a is formed like this, strictly speaking, it is possible that a side edge of the original document passes a location a little off the tip portion 325a, inward. Accordingly, it is possible that either of the corners of the original document 26, without being scooped up by the tip portion 325a, goes behind the guide member 16 through the recess 324. But, as the most interior portion 325a of the recess 324 is disposed outside the tip portion 324a, the front edge of the original document 26 does not engage with the most interior portion 324a. That is, even if only a corner of the original document 26 goes behind the guide member 16 at one time, the corner goes upward again through the recess 324, passes the outside edge portion 325c of the protrusion 325, and, with the rest of the original, is guided upward by the guide member 16.

Figure 15:
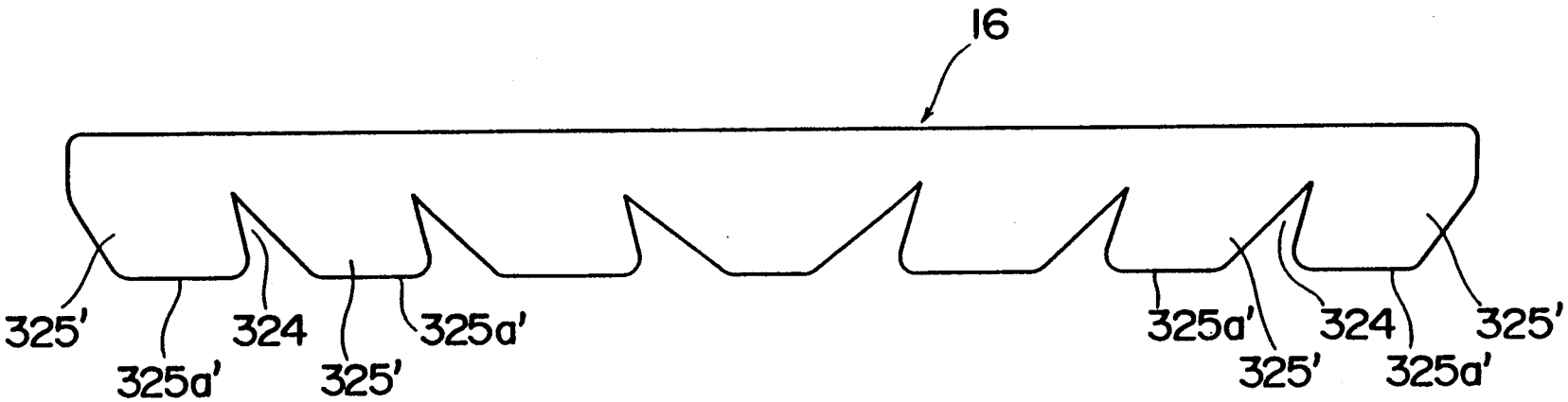
FIG. 15 is a plan view showing a fifth embodiment of a guide member of the present invention.

Further, as shown in FIG. 15, the protrusions 325' having flat tip portions 325a' as well as the ones shown in FIG. 11 may be formed in the width direction all over the guide member 16 which has the recesses 342 extending outward and the same outside edge portion of a protrusion may be commonly used for original documents of a plurality of (for example, two kinds of) sizes.

In all the above-mentioned embodiments, the guide member 16 applies to an image forming apparatus which copies the original document 26 with the center of the original document 26 corresponding with the center of the width of the image forming apparatus. However, a guide member with the recesses and protrusions formed so that both side edges of original documents of various standard sizes may pass the outside edge portions of the protrusions is suitable for an image forming apparatus which copies the original document 26, with one side edge of the original document 26 being a standard line of copying. Accordingly, the guide member may be asymmetrical with respect to the center line CL.

Further, in the above-mentioned embodiments, the free end of the guide member 16 is in contact with the upper surface 17a of the receiving member 17, but the free end may go into a recess formed in the upper surface 2a of the transparent plate 2. Further, the free end of the guide member 16 may be in contact with the side of the transparent plate 2 which is cut appropriately. Still further, the free end of the guide member 16 may be in contact with the upper surface of a stationary-type receiving member specially disposed on the downstream side of the transparent plate 2.

Further, in the above-mentioned embodiments, the guide member 16 is disposed on the downstream side of the transparent plate 2 and the guide member 16 is constructed so as to guide an original document after exposure in the discharging direction, but the guide member 16 may be disposed wherever an original document being conveyed in a a predetermined direction by conveying means should be deflected in another direction. More generally, the guide member can apply wherever a sheet member being conveyed should be deflected. For example, in an image forming apparatus capable of duplex copying, the guide member 16 is suitable for a sheet path where a sheet material is conveyed to an intermediate tray, after one surface of which is copied, or another sheet path where a sheet material is conveyed from the intermediate tray to a transfer portion.

What is claimed is:

1. An automatic document feeder for an image forming apparatus which comprises a transparent plate on which an original document is placed, said document feeder comprising:

(A) means for conveying the original document; and (B) a guide member for deflecting an original document conveyed by said conveying means, i) said guide member comprising a flexible thin piece projecting inclinedly with a free end kept in contact with a surface, ii) said flexible thin piece having a width and a center line central of its width and a plurality of recesses formed in said free end thereof, said recesses being formed in spaced-apart relationship in opposite directions away from said center line to provide a plurality of protrusions adjacent to said recesses, and iii) said protrusions each having an inside edge portion, an outside edge portion which generally is relatively further from said center line area than said inside edge portion, and a tip portion, said edge portions delimiting said recesses, iv) said outside edge portions of at least some of said protrusions having a length from its tip portion to an interior-most region of a recess adjacent thereto, which length is longer than a length of its inside edge portion which length is defined from said tip portion to an interior-most region of another recess adjacent said inside edge portion, v) said recesses and protrusions being formed and disposed such that both side edges of original documents of various standard sizes pass said tip portions or said outside edge portions of said protrusions.

2. The automatic document feeder of claim 1, wherein said interior-most regions of said recesses and said tip portions of said protrusions adjacent to each of said recesses are located such that said both side edges of original documents which are of various standard sizes will pass only said tip portions or said outside edge portions of said protrusions and will not pass said inside edge portions of said protrusions.

3. The automatic document feeder of claim 2, wherein said protrusions include a first set of protrusions and a second set of protrusions, wherein said protrusions of said first set thereof are formed symmetrically, and wherein said protrusions of said second set thereof are said protrusions having outside edge portions with longer lengths than their inside edge portions.

4. The automatic document feeder of claim 1, wherein said feeder comprises means for receiving said guide member, said receiving means being rotatable between a first position above said transparent plate to engage an original document and a second position below said transparent plate to disengage from the original document, said surface with which said free end of said guide member is kept in contact being provided by said receiving means.

5. The automatic document feeder of claim 4, wherein said guide member receiving means engages the original document when the document is placed by hand on said transparent plate after opening of said automatic document feeder.

6. The automatic document feeder of claim 2, wherein said guide member is disposed on a downstream side of said transparent plate in a conveying direction, and said guide member guides the original document on said transparent plate to a discharging portion.

7. The automatic document feeder of claim 1, wherein said interior-most region of each of said recesses is relatively further from said center line in one of said directions than are the tip portions of protrusions adjacent each of said recesses, whereby said both side edges of original documents which are of various standard sizes pass said tip portions or said outside edge portions of said protrusions.

8. The automatic document feeder of claim 7, wherein said protrusions include a first set of protrusions and a second set of protrusions, wherein each of said protrusions of said first set thereof are formed symmetrically, and wherein said protrusions of said second set thereof are said protrusions having outside edge portions with longer lengths than their inside edge portions.

9. The automatic document feeder of claim 7, wherein said guide member is disposed on a downstream side of said transparent plate, in a conveying direction, and said guide member guides the original document on said transparent plate to a discharging portion.

10. A guide member for deflecting a sheet material which is conveyed by a conveying means, said guide member comprising:

i) a flexible thin piece projecting inclinedly with a free end kept in contact with a surface, ii) said flexible thin piece having a width and center line central of its width and a plurality of recesses formed in said free end thereof, said recesses being formed in spaced-apart relationship in opposite directions away from said center line to provide a plurality of protrusions adjacent to said recesses, and iii) said protrusions each having an inside edge portion and an outside edge portion which generally is relatively further from said center line area than said inside edge portion, and a tip portion, said edge portions delimiting said recesses, iv said outside edge portions of at least some of said protrusions having a length from its tip portion to an interior-most region of a recess adjacent thereto, which length is longer than a length of its inside edge portion which length is defined from said tip portion to an interior-most region of another recess adjacent said inside edge portion, v) said recesses and protrusions being formed and disposed such that both side edges of sheet material of various standard sizes pass said tip portions or said outside edge portions of said protrusions.

11. The guide member of claim 10, wherein said interior-most regions of said recesses and said tip portions of protrusions adjacent to each of said recesses are located such that said both side edges of sheet materials which are of various standard sizes will pass only said tip portions or said outside edge portions of said protrusions and will not pass said inside edge portions of said protrusions.

12. The guide member of claim 10, wherein said interior-most region of each of said recesses is relatively further from said central line in one of said directions than are the tip portions of protrusions adjacent each of said recesses, whereby said both side edges of sheet materials which are of various standard sizes pass said tip portions or said outside edge portions of said protrusions.

13. The guide member of claim 10, wherein said protrusions include a first set of protrusions and a second set of protrusions, wherein each of said protrusions of said first set thereof are formed symmetrically, and wherein said protrusions of said second set thereof are said protrusions having outside edge portions with longer lengths than their inside edge portions.

14. The guide member of claim 10, wherein said thin piece is formed of a synthetic resin film.

15. The guide member of claim 10, wherein said thin piece is formed of an electrically conductive metal foil.

* * * * *